United States Patent [19]

Laesser

[11] 4,040,248

[45] Aug. 9, 1977

[54] ALARM ELECTRIC WATCH

[75] Inventor: Claude Laesser, La Chaux-de-Fonds, Switzerland

[73] Assignee: Ebauches S.A., Neuchatel, Switzerland

[21] Appl. No.: 618,824

[22] Filed: Oct. 2, 1975

[30] Foreign Application Priority Data

Oct. 11, 1974 Switzerland .....13687/74

[51] Int. Cl.[2] ..... G04C 21/28; G04C 21/34

[52] U.S. Cl. ..... 58/38 R; 58/19 A; 58/57.5

[58] Field of Search ..... 58/38, 50 R, 57.5, 152 B, 58/19 R, 19 A, 19 B, 19 C

[56] References Cited

U.S. PATENT DOCUMENTS

| | | | |
|---|---|---|---|
| 3,662.537 | 5/1972 | Fujimori | 58/91 |
| 3,733,810 | 5/1973 | Girard | 58/85.5 |
| 3,745,761 | 7/1973 | Tsuruishi | 58/38 |

*Primary Examiner*—E. S. Jackmon

*Attorney, Agent, or Firm*—St. Onge, Mayers, Steward & Reens

[57] ABSTRACT

An electric alarm watch with an electro-optical display and an alarm mechanism which is released by a time-selecting device including a manually displaceable time-selector mounted for movement to different positions corresponding to the time of day for selecting the time at which the alarm goes off. At each position of the time-selector a particular set or combination of electrically conducting members is engaged by an electrically conducting zone or brush for producing an electronic signal which is peculiar to that particular position of the time-selector. A decoder may be used for receiving this signal and supplying it in decoded form to a comparator which compares the information from the time-selector with that received from the time-display portion of the watch. The alarm goes off when the information from the watch circuit is in concordance with that received from the time-selector.

5 Claims, 4 Drawing Figures

ALARM ELECTRIC WATCH

The present invention relates to an alarm electric watch having a time electro-optic display device.

The watch includes a device for selecting the time at which the alarm is released, this time-selecting device comprising a manually displaceable element, such as a bezel, movably mounted for cooperation with a set of electrically conducting members associated with the electronic circuit of the watch. At each position of the bezel a different combination of conducting members is engaged, thereby producing a distinctive electronic signal for each position of the bezel, such that for each point of time at which the alarm is to be released, there is a corresponding combination of time-selecting conducting members which is brought into play by the displaceable element The drawing shows, by way of example, one embodiment of the invention.

Figure 2:
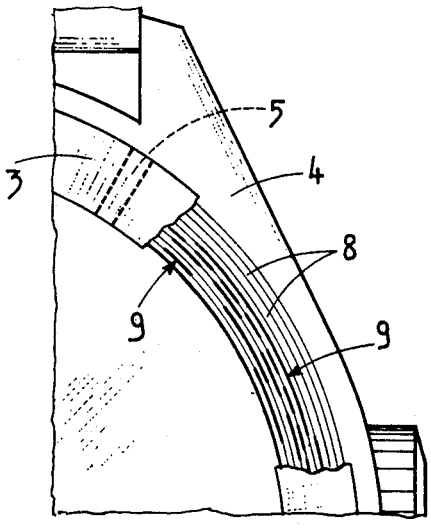
FIG. 2 is a plan view of a detail of this watch, at a larger scale, with a torn out portion.
Figure 3:
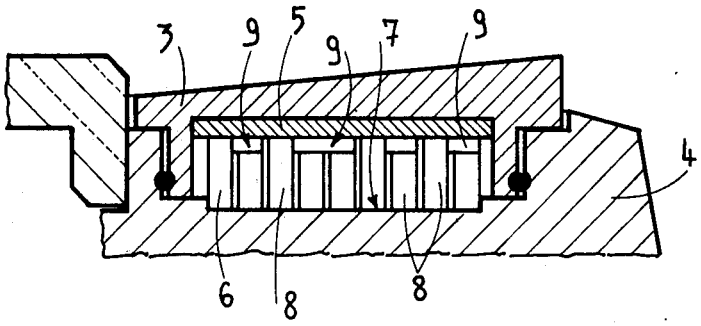
FIG. 3 is a sectional view of a detail, along line III—III of FIG. 1, at a larger scale.

The represented wrist-watch, generally designated by 1, comprises an electro-optic display device for the time, the indications of which are designated by 2. This watch, which is an alarm watch, comprises a rotatable bezel 3, rotatably mounted on the watch-casing body, designated by 4, and which is provided, on its inner surface facing the casing body 4, with an electrically conducting zone 5 (FIG. 3) constituting a shoe or brush arranged radially with respect to the center of the watch. This zone is connected to the casing body by a conductor 6. The casing body 4 carries, located in an annular recess 7 situated under the bezel 3, isolating members 8, having the shape of segments of an annular ring, coaxial to each other ring member 8 are provided at various places at some places, with conducting pieces 9 situated under the bezel 3, for contact with the radial brush 5 when this brush is situated above them. As may be seen in FIG. 2, conductors 9 are not only disposed at different points along each ring, but are also different in length both within each ring and from one ring to the next. Consequently, a virtually limitless number of combinations of different conductors 9 is availabe for electronically determining the time corresponding to each angular position of the bezel 3.

Figure 4:
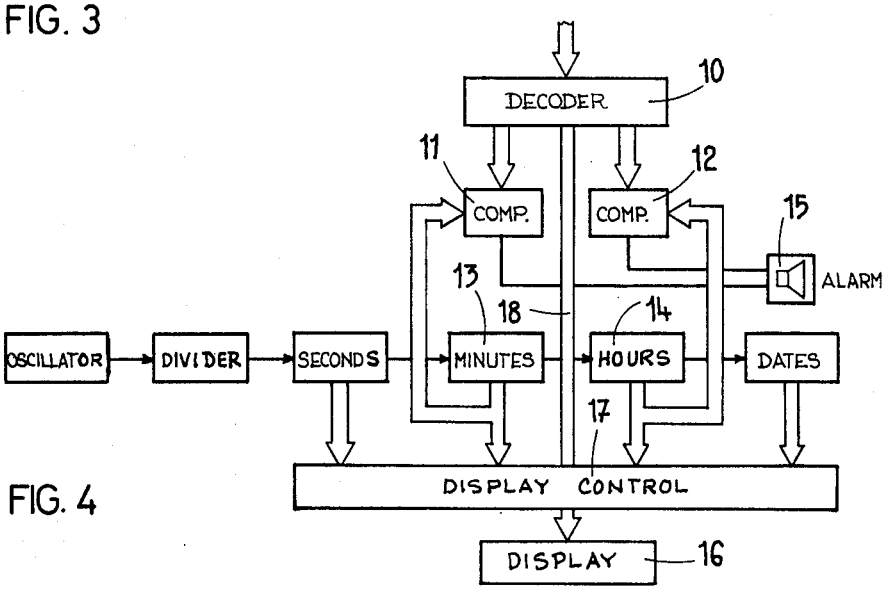
FIG. 4 is a block diagram of the electronic circuit of the watch.

The information furnished by the selector (bezel 3) constituted by the device as hereabove disclosed are sent to a decoder 10 which transforms them for sending them to two comparators 11 and 12, respectively of minutes and of hours, receiving also information coming from the stage 13 of the minutes and the stage 14 of the hours of the chain of division of the electronic circuit of the watch illustrated diagrammatically in FIG. 4. The comparator is arranged in such a way that any correspondence between the information it receives from the decoder and that which it receives from the electronic circuit of the watch produces the releasing of an acoustic alarm device 15.

Figure 1:
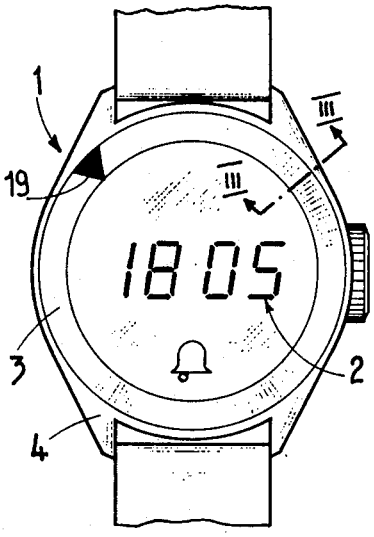
FIG. 1 is a plan view of an electronic wrist-watch, with electro-optic hour display.

The display device 16 (FIG. 4) of the watch may be provided with a conventional control system 17 for displaying the hours, minutes, seconds and dates in the usual manner. Information in the decoder 10 can be displayed on the display device 16 by a manual switch in a connection 18 between the decoder and display, so that the time at which the alarm has been set to go off is shown, at least momentarily. This switching can be effected either by means of a push-button which could be arranged on the casing of the watch, or by an axial movement which can be imported to the rotatable bezel 3 during its operation. The bezel 3 is however provided with a pointer 19 permitting the user to check, rapidly, the approximative time at which the alarm will be released. Thus, in the example represented in FIG. 1, it can be seen that this time is about 10:30 o'clock.

As a modification it is possible to mount one or more brushes, similar to brush 5, in a fixed position in the casing body with conducting tracks that correspond to conductors 9 carried by the bezel. These contact tracks can be realized either by means of printed circuits, or by removing or de-forming the material.

What I claim is:

1. An alarm electric watch having an electro-optical display for the time and an alarm mechanism, said watch having a selecting device for the time at which the alarm is released, said time-selecting device comprising a manually displaceable element movable carried by a support element of said watch, one of said elements having an electrically conducting zone, a plurality of electrically conducting members associated with the electronic circuit of the watch carried by the other of said elements such that upon movement of said displaceable element a different combination of said conducting members makes contact with said conducting zone at each position of said displaceable element, each of said combinations of conducting members determining the time at which said alarm is released.

2. An alarm electric watch as defined in claim 1, which further comprises a decoder for receiving information supplied by said selecting device, a comparator connected to said decoder for receiving information as to the position of said time-setting device, said electro-optical display having a feed circuit to which said comparator is also connected for receiving information as to the time kept by watch, whereby any concordance between the two type of information received by said comparator activates said alarm.

3. An alarm electric watch as defined in claim 1, wherein said conducting zone comprises a brush and said conducting members are interposed between isolating members and are arranged such that upon movement of said displaceable element the combination of conducting members in contact with said brush is varied from one position of said displaceable element to the next.

4. An alarm electric watch as defined in claim 3, wherein said displaceable element comprises a rotatable bezel.

5. An alarm electric watch as defined in claim 1, which further comprises a decoder for receving information supplied by said selecting device and a manually operable switching device capable of connecting said decoder to said electro-optical display for displaying the time selected for release of the alarm instead of the time of day.

* * * * *